US005860199A

United States Patent [19]

Liu

[11] Patent Number: 5,860,199

[45] Date of Patent: Jan. 19, 1999

[54] QUICK-RELEASE BELT BUCKLE

[76] Inventor: Chun Chien Liu, 4, Chungchu Hsiang, Chungkou Tsun, Huatang Hsiang, Changhua Hsien, Taiwan

[21] Appl. No.: 30,740

[22] Filed: Feb. 25, 1998

[51] Int. Cl.[6] ..... A41F 1/00; A44B 11/26

[52] U.S. Cl. ..... 24/656; 24/633; 24/625

[58] Field of Search ..... 24/656, 653, 652, 24/633, 629, 628, 588, 589, 597, 31 R; 2/338

[56] References Cited

U.S. PATENT DOCUMENTS

| | | | |
|---|---|---|---|
| 3,522,640 | 8/1970 | Lohr | 24/656 |
| 3,675,281 | 7/1972 | Stephenson | 24/656 |
| 4,425,688 | 1/1984 | Anthony et al. | 24/656 |
| 4,457,052 | 7/1984 | Hauber | 24/656 |
| 4,866,819 | 9/1989 | Kasai | 24/633 X |
| 5,113,556 | 5/1992 | Murai et al. | 24/633 |
| 5,551,131 | 9/1996 | Anscher | 24/625 X |

*Primary Examiner*—Anthony Knight
*Assistant Examiner*—Robert J. Sandy
*Attorney, Agent, or Firm*—Pro-Techtor International Services

[57] ABSTRACT

A quick-release belt buckle which includes a body fastened to a first end of a belt, the body having a I-shaped retainer block supported on a spring in between a bottom plate and a top cover plate, and a plug member fastened to a second end of the belt, the plug member having a hooked retaining portion at a front end thereof which is forced into engagement with a beveled bottom wall of the retainer block when the plug member is inserted into a mouth in an open frame in the body, the plug member being disconnected from the retainer block when the retainer block is pressed down to compress the spring.

3 Claims, 5 Drawing Sheets

QUICK-RELEASE BELT BUCKLE

BACKGROUND OF THE INVENTION

The present invention relates to a belt buckle used for joining the ends of a belt, and more particularly to a quick-release belt buckle.

FIG. 1 shows a collar for dog. The collar is comprised of a strap 9, and a quick-release hook 90 used for joining the ends of the strap 9. The quick-release hook 90, as shown in FIGS. 2 and 3, is comprised of a receptacle 91, and a plug member 92. The receptacle 91 comprises a transverse belt slot 99 at the rear side for fastening to one end of the strap, a mouth 93 at the front side for receiving the plug member 92, and two side retaining holes 94 at two opposite lateral sides in communication with the mouth 93. The plug member 92 comprises two transversely disposed parallel belt slots 95 at the rear side for fastening to one end of the strap, a longitudinal middle stop rod 97 at the front side, and two springy hooks 96 bilaterally spaced from the stop rod 97 at the front side. When the springy hooks 96 and the stop rod 97 are inserted into the mouth 93 in the receptacle 91, the springy hooks 96 are squeezed inwards for permitting the plug member 92 to be inserted into position. After the plug member 92 has been inserted into position, the springy hooks 96 immediately return to their former shape and are respectively hooked in the side retaining holes 94, and at the same time a click sound is produced (see FIG. 3). When unfastening the quick-release hook 90, the springy hooks 96 are squeezed inwards and disengaged from the side retaining holes 94 on the receptacle 91, permitting the plug member 92 to be disconnected from the receptacle 91 (see FIG. 4). In order to provide the springy hooks 96 with sufficient springy power, the thickness of the springy hooks 96 is limited. However, the structural strength of the springy hooks 96 become weak when they are made thinner. Further, because only plastics can be used for making this structure of quick-release hook 90, the mechanical properties of the quick-release hook 90 limits its application range.

SUMMARY OF THE INVENTION

The present invention has been accomplished to provide a quick-release belt buckle which eliminates the aforesaid drawbacks. It is one object of the present invention to provide a quick-release belt buckle which can be made from metal. It is another object of the present invention to provide a quick-release belt buckle which is durable and safe in use. It is still another object of the present invention to provide a quick-release belt buckle which provides a broad application range. A quick-release belt buckle in accordance with one embodiment of the present invention is generally comprised of a body fastened to a first end of a belt, and a plug member fastened to a second end of the belt and detachably connected to the body. The body comprises a I-shaped retainer block supported on a spring in between a bottom plate and a top cover plate. The plug member has a hooked retaining portion at a front end thereof which is forced into engagement with a beveled bottom wall of the retainer block when the plug member is inserted into a mouth in an open frame in the body. The plug member is disconnected from the retainer block when the retainer block is pressed down to compress the spring.

DETAILED DESCRIPTION OF THE PREFERRED EMBODIMENT

Figure 1:
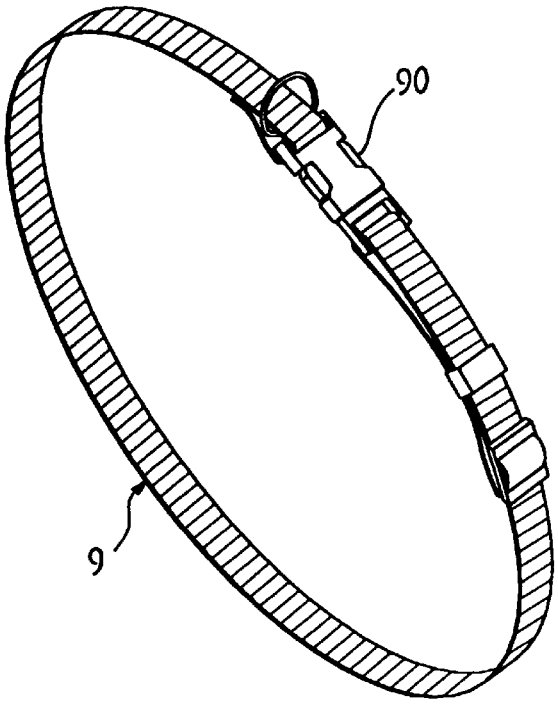
FIG. 1 (Prior Art)
FIG. 1 is a perspective view of a collar with a quick-release hook according to the prior art.
Figure 2:
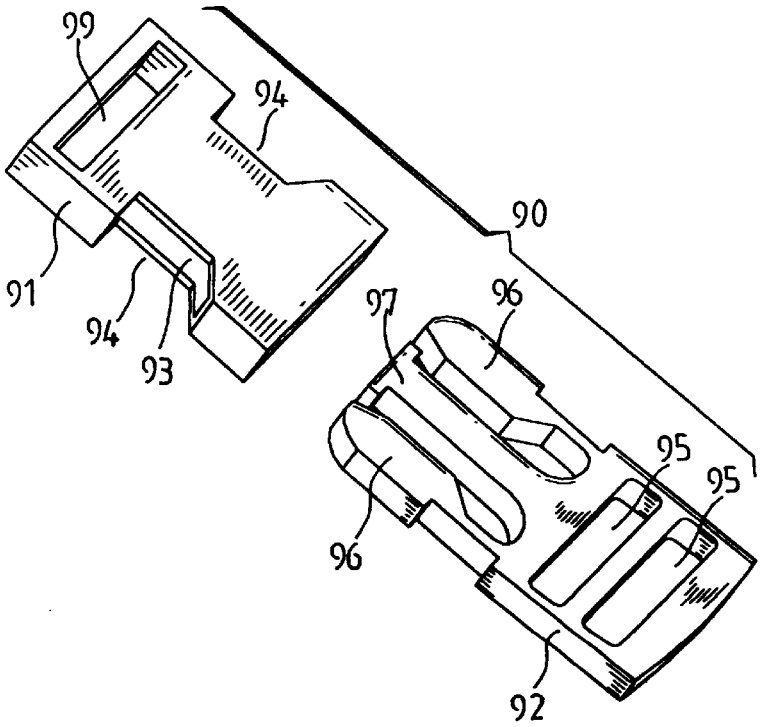
FIG. 2 (Prior Art)
FIG. 2 is an exploded view of the quick-release hook shown in FIG. 1.
Figure 3:
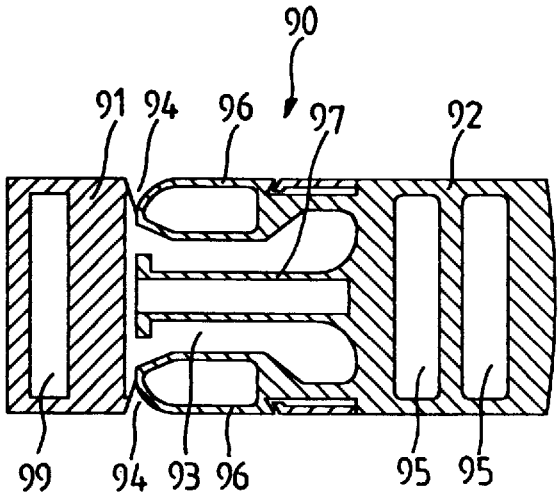
FIG. 3 (Prior Art)
FIG. 3 is a sectional assembly view of FIG. 2, showing the quick-release hook fastened up.
Figure 4:
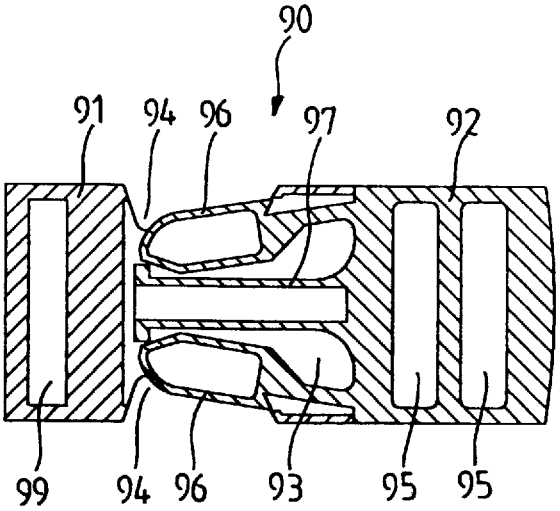
FIG. 4 (Prior Art)
FIG. 4 is similar to FIG. 3 but showing the hooks of the plug member squeezed inwards.
Figure 5:
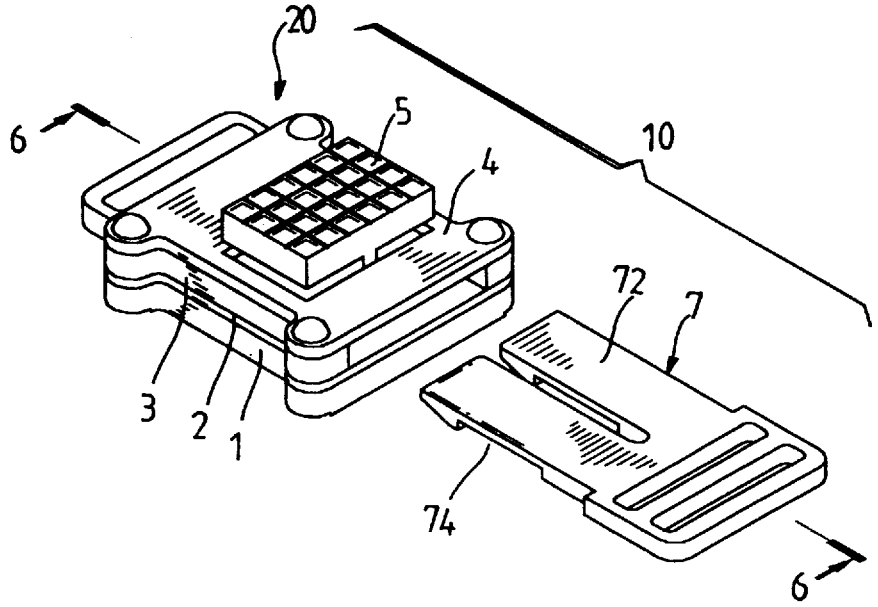
FIG. 5 is a perspective view of a quick-release belt buckle according to the present invention.
Figure 6:
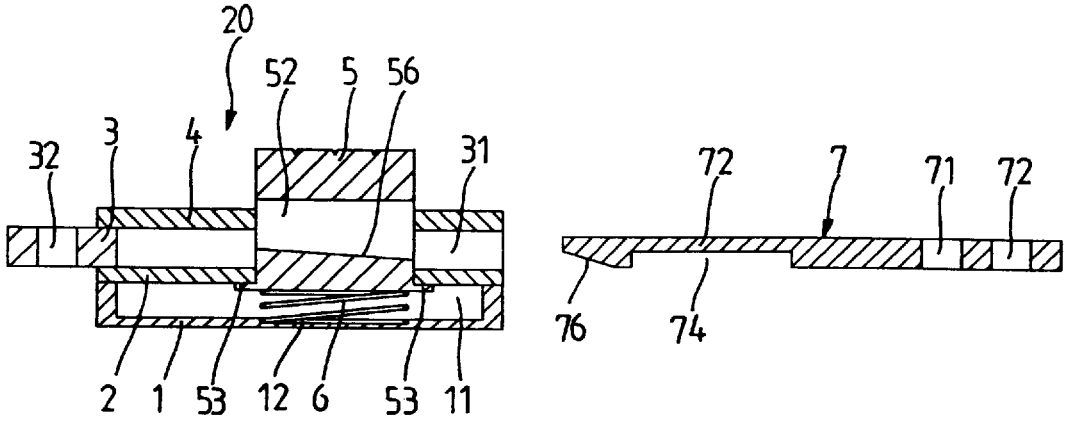
FIG. 6 is a sectional view taken along line 6—6 of FIG. 5.
Figure 7:
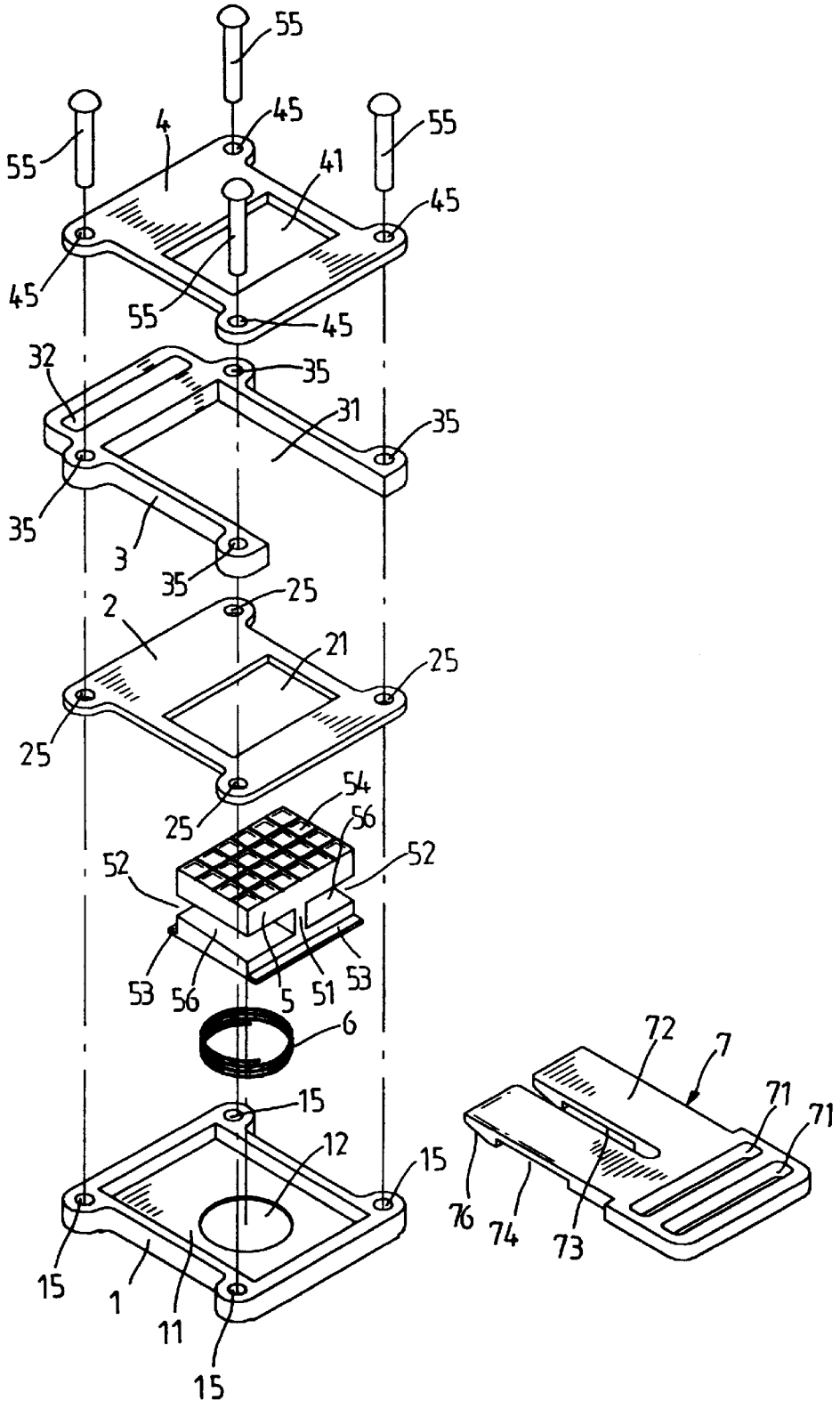
FIG. 7 is an exploded view of the quick-release belt buckle shown in FIG. 5.

Referring to FIGS. 5, 6 and 7, a belt buckle 10 is shown comprised of a body 20, and a plug member 7. The body 20 is comprised of a bottom plate 1, a cushion 2, an open frame 3, a top cover plate 4, and a retainer block 5, and a spring 6. Except the retainer block 5 and the spring 6, the other parts of the body 20 are made from stainless steel by stamping.

Figure 8:
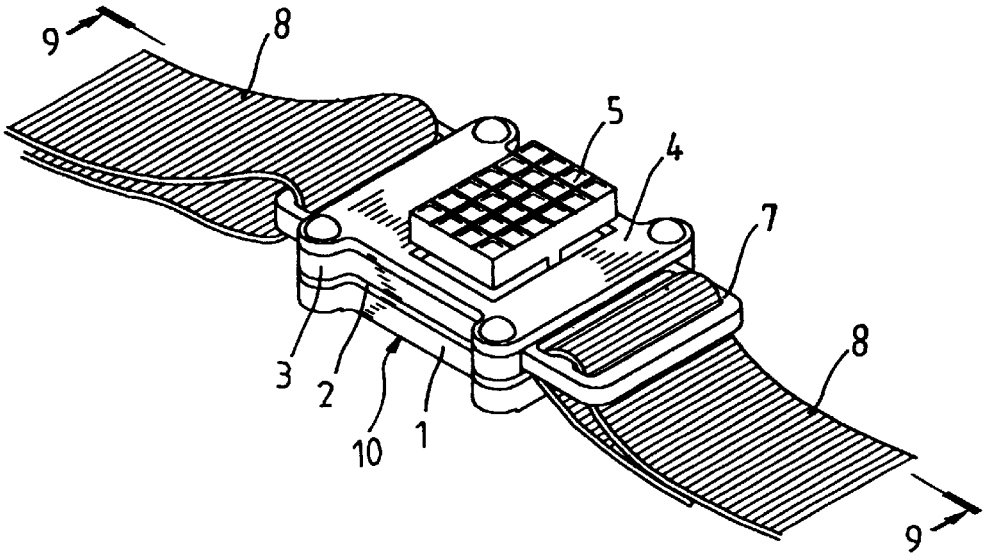
FIG. 8 shows the quick-release belt buckle installed.

Referring to FIG. 8 and FIGS. from 5 to 7 again, the bottom plate 1 is a flat rectangular plate having a recessed portion 11 at the center, a circular seat 12 at the recessed portion 11, and four mounting holes 15 in four corners thereof. The spring 6 has a bottom side fastened to the circular seat 12 at the bottom plate 1, and a top side connected to the bottom side of the retainer block 5. The cushion 2 fits over the bottom plate 1, having an opening 21 through which the retainer block 5 passes, and four mounting holes 25 in four corners thereof respectively connected to the mounting holes 15 on the bottom plate 1. The open frame 3 is a substantially U-shaped frame supported on the cushion 2, defining a mouth 31 into which the plug member 7 is inserted. The open frame 3 is relatively longer than the cushion 2, having four mounting holes 35 respectively fastened to the mounting holes 25 on the cushion 2 and the mounting holes 15 on the bottom plate 1, and a transverse belt slot 32 at one end which holds one end of a belt 8 (see FIG. 8). The top cover plate 4 is a flat rectangular frame covered on the open frame 3, having four mounting holes 45 in four corners thereof respectively fastened to the mounting holes 35 on the open frame 3, the mounting holes 25 on the cushion 2 and the mounting holes 15 on the bottom plate 1 by rivets 55, and an opening 41 corresponding to the mouth 31 in the open frame 3 and the opening 21 on the cushion 2 through which the retainer block 5 passes. The retainer block 5 is an I-block comprised of a beveled bottom wall 56 supported on the spring 6 within the recessed portion 11 of the flat bottom plate 1, a flat top wall 54 protruding from the opening 41 of the top cover plate 4, a vertical rib 51 connected between the beveled bottom wall 56 and the flat top wall 54 on the middle and suspending in the opening 21 on the cushion 2 and the mouth 31 in the open frame 3, and two outward stop flanges 53 respectively raised from front and rear sides of the beveled bottom wall 56 for stopping the beveled bottom wall 56 in between the flat bottom plate 1 and the cushion 2. The top side of the flat top wall 54 is preferably embossed with an anti-skid pattern for positive grip of the hand. The distance between the outward stop flanges 53 is relatively greater than the width of the opening 21 on the cushion 2, therefore the outward stop flanges 53 stop the beveled bottom wall 56 in between the flat bottom plate 1 and the cushion 2. Further two passage ways 52 are defined between the flat top wall 54 and the beveled bottom wall 56 at two opposite sides of the vertical rib 51 for receiving the plug member 7. The plug member 7 comprises two transversely disposed parallel belt slots 71 which hold one end of the belt 8, a plug portion 72 corresponding to the mouth 31 in the open frame 3, a longitudinal opening 73 on the middle of the plug portion 72 for receiving the vertical rib 51 of the retainer block 5, a recessed receiving portion 74 at the bottom side of the plug portion 72, and a hooked retaining portion 76 at one end of the plug portion 72 in front of the recessed receiving portion 74. The hooked retaining portion 76 has a bottom side sloping downwardly backwards. Therefore, the hooked retaining portion 76 can be smoothly moved over the beveled bottom wall 56 of the retainer block 5 into engagement with the vertical back side of the beveled bottom wall 56 of the retainer block 5.

Figure 9:
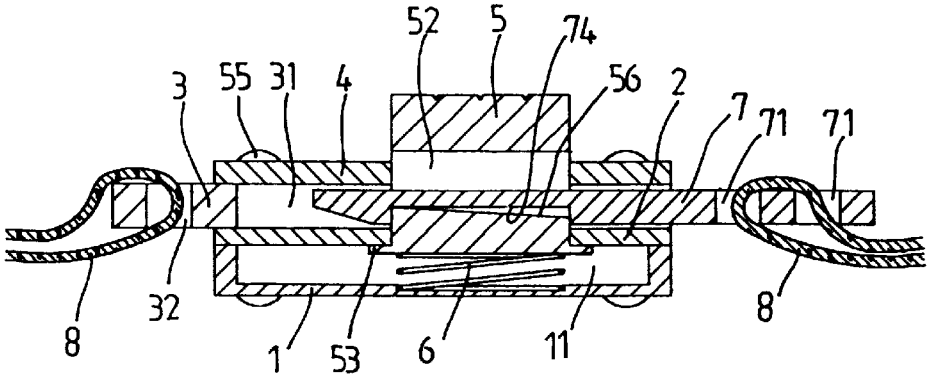
FIG. 9 is a sectional view taken along line 9—9 of FIG. 8.
Figure 10:
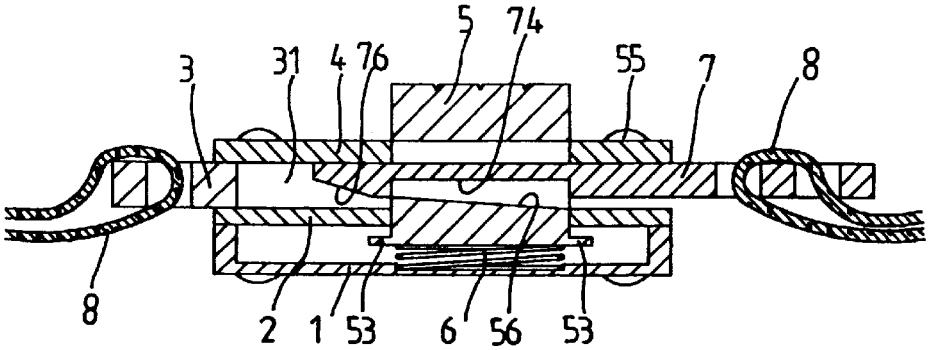
FIG. 10 is similar to FIG. 9 but showing the retainer block pressed down, the hooked retaining portion of the plug member disengaged from the beveled bottom wall of the retainer block.

Referring to FIGS. 9 and 10, when the plug portion 72 of the plug member 7 is inserted into the mouth 31 in the open frame 3 and the passage ways 52 in between the flat top wall 54 and the beveled bottom wall 56 at two opposite sides of the vertical rib 51 along the beveled top side of the beveled bottom wall 56 of the retainer block 5, the retainer block 5 is forced to lower in the opening 21 within the cushion 2, enabling the hooked retaining portion 76 of the plug member 7 to be forced into engagement with the vertical back side of the beveled bottom wall 56 of the retainer block 5 and the beveled bottom wall 56 of the retainer block 5 to be received in the recessed receiving portion 74 at the bottom side of the plug portion 72 of the plug member 7, and therefore the plug member 7 and the body 10 are fastened together (see FIG. 9). When the hooked retaining portion 76 of the plug member 7 is moved over the beveled bottom wall 56 of the retainer block 5 and forced into engagement with the vertical back side of the beveled bottom wall 56, a click sound is produced. When the retainer block 5 is pressed down with the hand to compress the spring 6, the hooked retaining portion 76 of the plug member 7 is disengaged from the vertical back side of the beveled bottom wall 56, enabling the plug member 7 to be disconnected from the body 10 (see FIG. 10).

While only one embodiment of the present invention has been shown and described, it will be understood that various modifications and changes could be made thereunto without departing from the spirit and scope of the invention disclosed.

What the invention claimed is:

1. A quick-release belt buckle fastened to a belt for joining the ends of the belt, comprising:

a bottom plate having a recessed portion at the center, a circular seat at said recessed portion, and four mounting holes in four corners thereof;

a spring fastened to said circular seat in said recessed portion within said bottom plate;

a cushion supported on said spring, said cushion having an opening, and four mounting holes in four corners thereof respectively connected to the mounting holes on said bottom plate;

an open frame covered on said cushion, said open frame comprising a mouth, four mounting holes respectively fastened to the mounting holes on said cushion and the mounting holes on said bottom plate, and a transverse belt slot at one end which holds a first end of the belt;

a top cover plate covered on said open frame, said top cover plate having four mounting holes in four corners thereof respectively fastened to the mounting holes on said open frame, the mounting holes on said cushion and the mounting holes on said bottom plate, and an opening corresponding to the mouth in said open frame and the opening on said cushion;

a retainer block mounted in the mouth in said open frame and the opening on said cushion and supported on said spring above said flat bottom plate, said retainer block comprising beveled bottom wall supported on said spring within the recessed portion of said flat bottom plate, a flat top wall extending out of the opening on said top cover plate, a vertical rib connected between said beveled bottom wall and said flat top wall on the middle and suspending in the opening on said cushion and the mouth in said open frame, two outward stop flanges respectively raised from front and rear sides of said beveled bottom wall for stopping said beveled bottom wall in between said flat bottom plate and said cushion, and two passage ways defined between said flat top wall and said beveled bottom wall at two opposite sides of said vertical rib; and a plug member fastened to a second end of the belt, said plug member comprising two transversely disposed parallel belt slots which hold the second end of the belt, a plug portion for inserting into the mouth in said open frame and the passage ways between the flat top wall and beveled bottom wall of said retainer block at two opposite sides of said vertical rib, a longitudinal opening on the middle of said plug portion for receiving the vertical rib of said retainer block, a recessed receiving portion at a bottom side of said plug portion for receiving the beveled bottom wall of said retainer block, and a hooked retaining portion at one end of said plug portion in front of said recessed receiving portion for engagement with a vertical back side of the beveled bottom wall of said retainer block.

2. The quick-release belt buckle of claim 1, wherein the flat top wall of said retainer block has a top side embossed with an anti-skid pattern.

3. The quick-release belt buckle of claim 1, wherein the hooked retaining portion of said plug member has a bottom side sloping downwardly backwards.

* * * * *